United States Patent [19]

Jenkins et al.

[11] Patent Number: 4,568,089

[45] Date of Patent: Feb. 4, 1986

[54] BALL-RETURNING TENNIS NET ASSEMBLY

[76] Inventors: Craig D. Jenkins; Scott E. Jenkins, both of 658 S. Reed Ct., Lakewood, Colo. 80226; Jerold D. Jenkins, 2950 Montibello Dr., Colorado Springs, Colo. 80918

[21] Appl. No.: 584,916

[22] Filed: Feb. 29, 1984

[51] Int. Cl.[4] ..... A63B 29/38

[52] U.S. Cl. ..... 273/29 A; 273/29 B

[58] Field of Search ..... 273/29 B, 30, 29 R, 273/26 D, 395, 181 F, 182 R, 182 A, 29 A; 124/26, 27, 28, 29, 36, 41 R, 83, 1

[56] References Cited

U.S. PATENT DOCUMENTS

| | | | |
|---|---|---|---|
| 1,166,496 | 1/1916 | Torrey | 273/181 F |
| 3,966,205 | 6/1976 | Schain et al. | 273/29 A |
| 4,025,071 | 5/1977 | Hodges | 273/29 A |
| 4,204,679 | 5/1980 | Kreuzman | 273/29 A |
| 4,243,221 | 1/1981 | Godinho | 273/29 A |
| 4,456,252 | 6/1984 | Hartland | 273/29 A |

FOREIGN PATENT DOCUMENTS

| | | | |
|---|---|---|---|
| 407045 | 3/1934 | United Kingdom | 273/181 F |
| 408944 | 4/1934 | United Kingdom | 273/181 F |

*Primary Examiner*—Richard C. Pinkham
*Assistant Examiner*—T. Brown
*Attorney, Agent, or Firm*—Harvey B. Jacobson

[57] ABSTRACT

A ball-returning tennis net assembly comprises a net structure of an inner net and an outer net on each side of the inner net for gathering balls hit into the net structure in a manner preventing the balls from rebounding onto a playing surface of a tennis court and for causing the balls to drop into an elongate inclined tray positioned along the base of the net so that the collected balls will roll down the tray to one end of the net structure. The tray delivers the ball to an automatic ball return mechanism at the side of the court which has a powered paddle device for batting the balls to a selected location at either end of the court.

15 Claims, 7 Drawing Figures

BALL-RETURNING TENNIS NET ASSEMBLY

BACKGROUND OF THE INVENTION

One aspect of the game of tennis which may be considered irritating, is the need to retrieve balls which are hit into the net. If, for example, a player's first serve hits the net and comes to rest within the court, it may present an obstruction or hazard which needs to be removed prior to continuing play, thereby causing an interruption to the smooth flow of a game. Also, balls hit into the net at other times need to be retrieved, as do balls which are hit into the net when, for example, a player is practicing serves from alternative sides of the court using a number of balls.

The present invention provides an apparatus which automatically gathers balls hit into the net, preventing the balls rebounding onto the playing surface, guides the ball to a location at the side of the court, and, in a preferred form, projects the collected balls to the back of the court.

STATEMENT OF PRIOR ART

The following U.S. Patents pertain generally to tennis net and ball projecting structures. None of these, however, discloses apparatus similar in concept or construction to the apparatus of the present invention.

U.S. Pat. No. 2,615,715, J. B. Moore, Oct. 28, 1952
U.S. Pat. No. 3,203,696, H. R. Sawyer, Aug. 31, 1965
U.S. Pat. No. 4,073,491, W. J. Sepaniac, Feb. 14, 1978
U.S. Pat. No. 4,203,413, K. M. Hodges, May 20, 1980
U.S. Pat. No. 4,256,303, E. C. Dobbins, Mar. 17, 1981
U.S. Pat. No. 4,288,074, N. Kainz, Sept. 8, 1981
U.S. Pat. No. 4,368,885, M. Katada et al., Jan. 18, 1983

SUMMARY OF THE INVENTION

Apparatus in accordance with the invention comprises a specifically designed tennis net structure adapted to retain and gather balls which are mis-hit into the net so that such balls are caused to drop to the base of the net rather than rebounding onto the court. Positioned under the net across the width of the court in accordance with a further feature of the invention, there is preferably positioned an inclined tray which collects balls hit into the net and causes the balls to roll under gravity to one side of the court. Balls from the tray may, in accordance with still another feature of the invention, be received in a power-operated ball return mechanism located adjacent one of the net posts, the mechanism being adapted automatically to return the balls to a selected location at one or other end of the court.

Accordingly, in use of the invention, the automatic return mechanism may be set to return balls to a selected location on the court on either side of the net. Any ball mis-hit into the net will be gathered and caused to drop into the tray so that it rolls down to the ball return mechanism and is returned to the required location. Details of a net structure, tray and ball return mechanism in accordance with the invention will be described more fully hereinafter.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF PREFERRED EMBODIMENT

Figure 1:
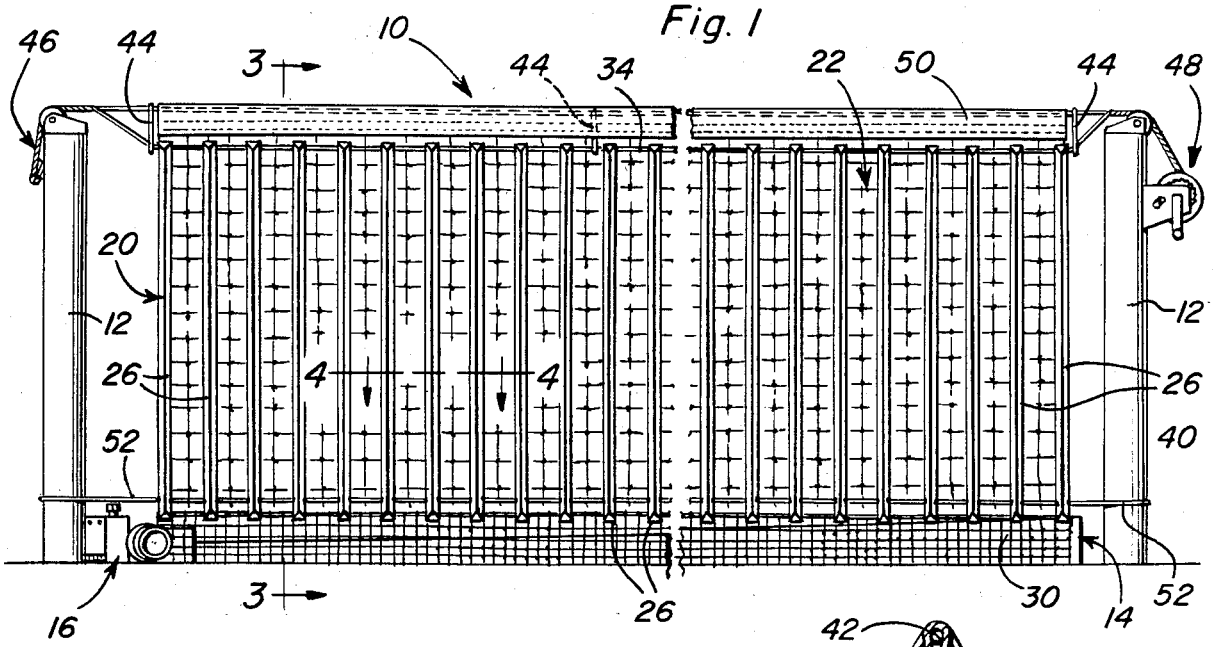
FIG. 1 is a front elevational view of a ball-returning tennis net assembly in accordance with the invention.
Figure 2:
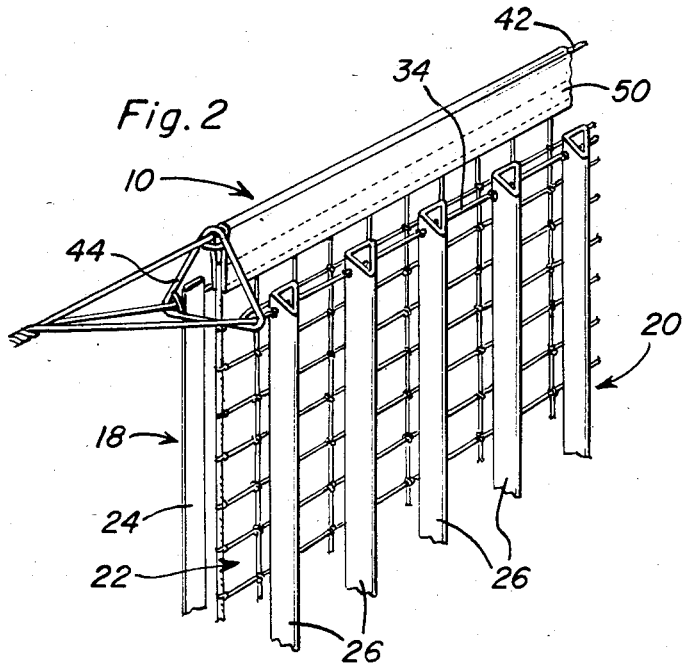
FIG. 2 is a perspective view of a portion of the net structure of the assembly.
Figure 3:
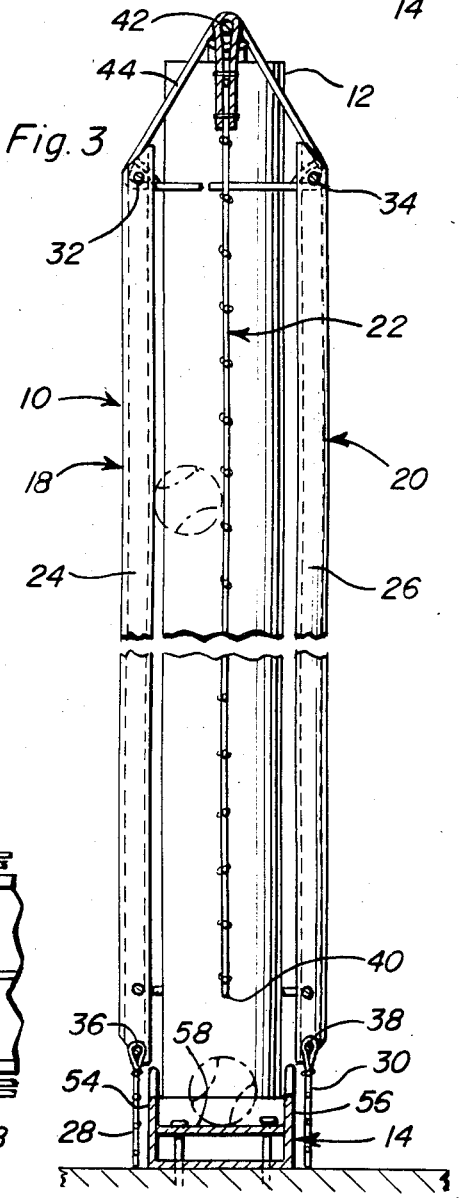
FIG. 3 is a sectional view on line 3—3 of FIG. 1 on an enlarged scale.
Figure 4:
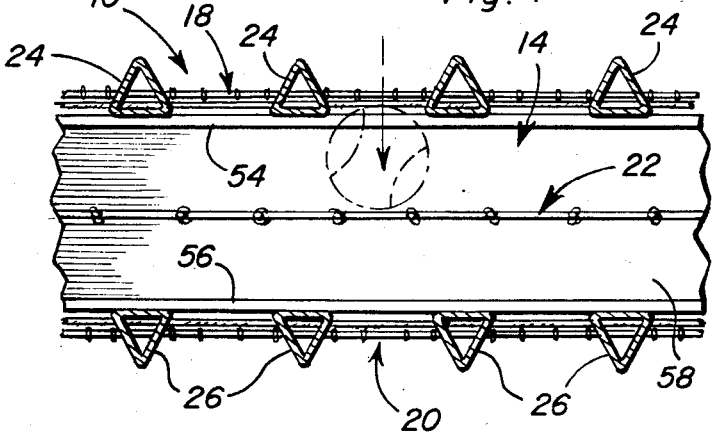
FIG. 4 is sectional view on line 4—4 of FIG. 1 also on an enlarged scale.
Figure 5:
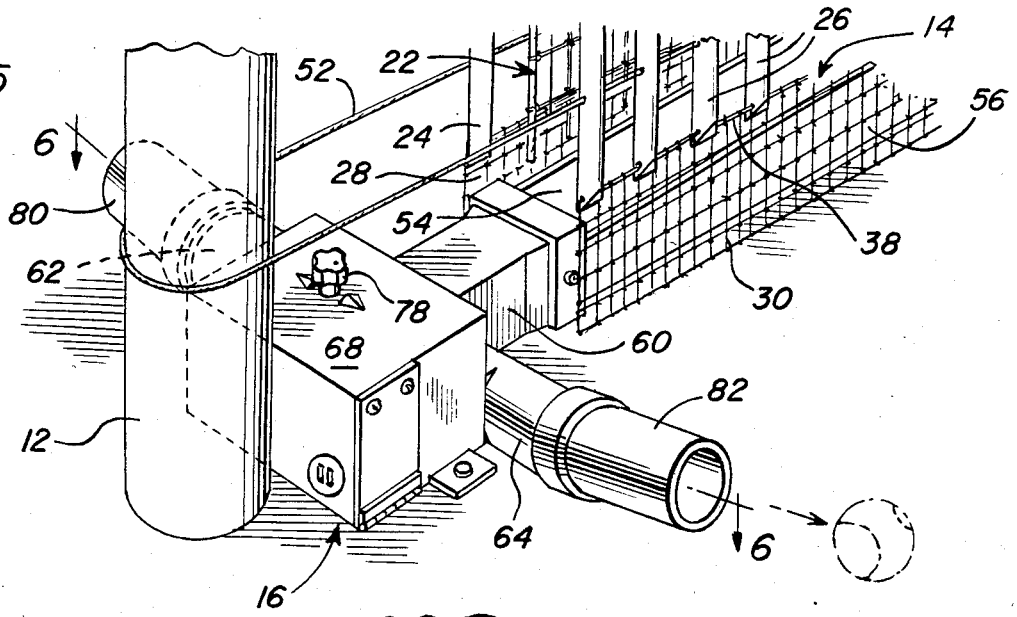
FIG. 5 is perspective view of a part of the assembly including an automatic ball-return mechanism.

The drawings illustrate a ball-returning tennis net assembly for use on a tennis court for gathering balls which are mis-hit ino the net and automatically returning the balls to a required location at either end of the court. The illustrated assembly comprises three basic components which constitute the invention either singly or in combination, notably a specialized net structure 10 suspended between conventional net posts 12, a ball collection tray 14 under the net structure, and an automatic ball-return mechanism 16 at one end of the net structure which receives balls from the tray and projects them to the required location.

Net structure 10 comprises a pair of identical outer nets 18, 20 and an inner net 22. The outer nets have upper sections of spaced vertically aligned tubular plastic or like rods 24, 26, and lower sections 28, 30 of small-gauge mesh up to a height of about three or four inches. Rods 24, 26 may be of triangular form, about $\frac{3}{4}$ inch in width and equally spaced apart at about $2\frac{3}{4}$ inch intervals along the length of the net structure, the apexes of the respective rods facing outwardly of the structure. For maximum visibility through the net structure, it is preferred that the rods be mutually aligned in both the outer nets. The rods are suspended at their upper ends from multistrand-wire cables 32, 34 and are connected to mesh sections 28, 30 by further cables 36, 38. The mesh sections serve to prevent balls bouncing out of tray 14 as they roll down to the ball-return mechanism.

Inner net 22 is formed by conventional tennis net mesh with its lower edge 40 cut on a incline corresponding to the incline of tray 14 and spaced about four inches above the tray. The inner net is located over the center line of the tray, so that a ball hit from either side of the court will fall into the tray. Net 22 is suspended from a multi-strand wire cable 42.

The cables 32, 34 and 42 are spaced apart and located by triangular brackets 44, the cables being welded, for example, in the corners of the brackets. There may, for example, be four brackets spaced along the length of the structure. Each side of the bracket may, for example, be about $6\frac{1}{2}$ includes in length, which establishes the approximate overall width of the net structure. The height of the inner net is the regulation tennis net height. Cables 32, 34 and 42 may be braided or wound together at the opposite ends to provide a single cable secured to posts 12 by conventional attachment and tensioning means indicated at 46, 48. The top of the net may have a white plastic or other cover 50 as in conventional nets.

The lower sections 28, 30 of the outer nets may be connected to tray 14 by metal snaps (not shown) and a metal cable 52 may run from one post 12 through the length of one of the outer nets to the opposite post 12 and back through the other outer net. This cord when tightened secures the outer nets and tray in position and keeps the outer nets taut.

When a ball is hit into the net structure, it penetrates the respective outer net and impacts the inner net which stops the ball. If the impact is of sufficient magnitude, the inner net will be pushed back and the rebound will tend to propel the ball back toward the playing area of the court. However, the rods 24 or 26 act as a barrier preventing this action and causing the ball to drop into tray 14 at the bottom of the inner net, the ball then rolling down the tray into the return mechanism 16.

Tray 14 which extends under the entire length of the net structure has sidewalls 54, 56 and an inclined base 58 of sufficient slope (e.g. about 5°) to insure that a ball landing in the tray at any point along its length will roll down to the return mechanism. The tray may, for example, comprise plastic snap-together sections.

The automatic ball-return mechanism 16 is of a hollow, generally T-shaped form having one limb 60 forming a connection with tray 14, opposed tubular limbs 62, 64 for projecting balls to opposite ends of the courts respectively, and a box section 68 containing a ball projection mechanism as will be described.

Figure 7:
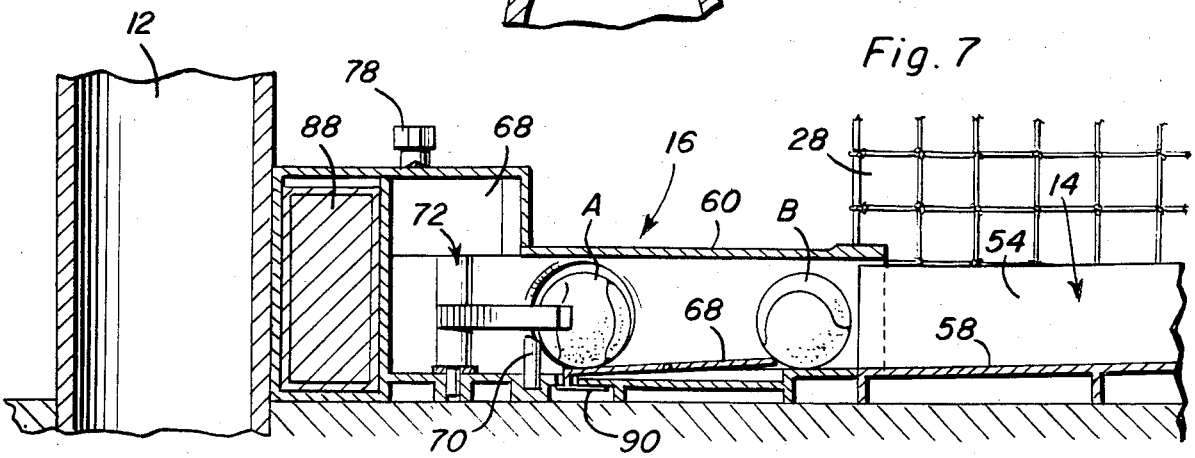
FIG. 7 is a sectional elevational view through the ball-return mechanism.

Within limb 60 of the ball-return mechanism is a pivotal ball-arresting lever 68 over which a ball A rolls upon receipt from tray 14, the ball coming to rest against a vertical ball stop 70 which positions the ball in the path of a ball return paddle device 72. It will be noted (see particularly FIG. 7) that in this condition of the apparatus, the right end of lever 68 adjacent tray 14 is elevated thereby arresting an oncoming ball B until ball A has been expelled from the device.

Figure 6:
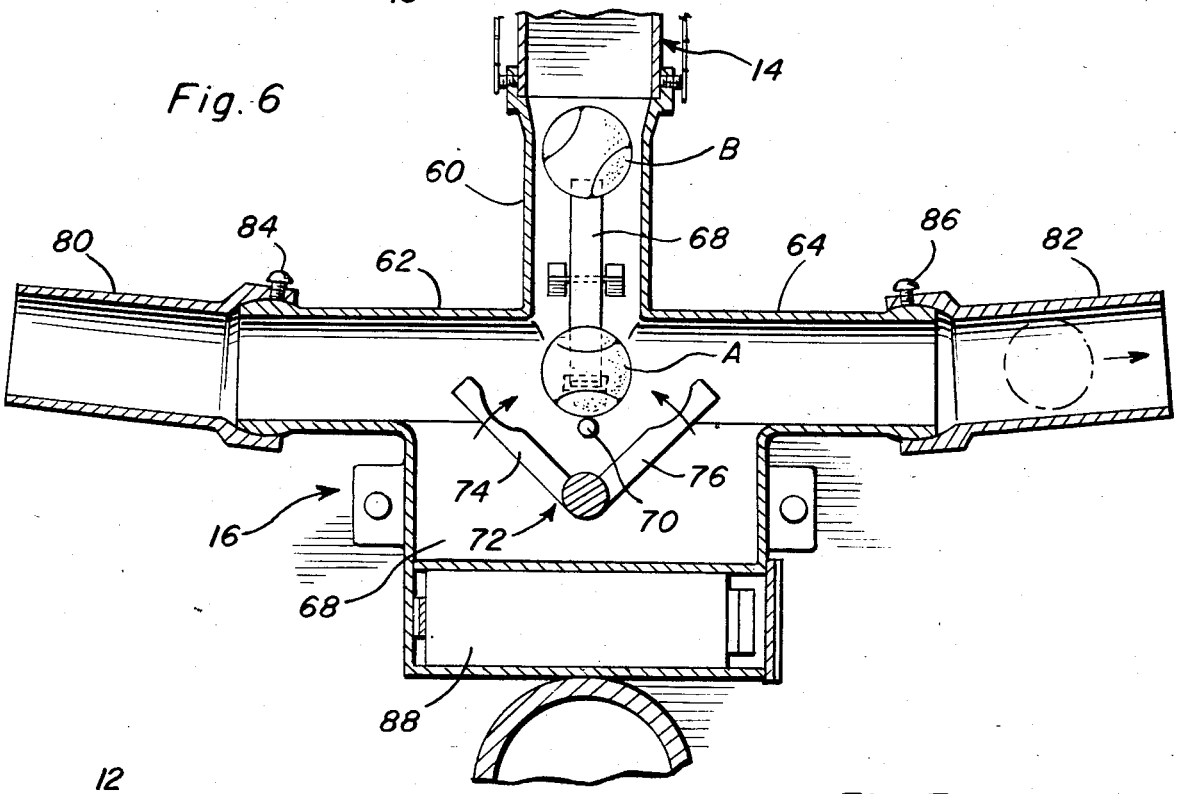
FIG. 6 is a sectional view on line 6—6 of FIG. 5.

Paddle mechanism 72 is pivoted about a vertical axis and includes a pair of opposed oscillatory paddles 74, 76. The device includes a manual setting knob 78 for causing it to operate selectively in a clockwise or counterclockwise direction. When set to operate in a clockwise direction (as viewed in FIG. 6) paddle 74 is effective to bat ball A out through limb 64 of the device, and when set to operate in a counterclockwise direction, paddle 76 is effective to bat ball A out through limb 62 of the device. Thus, according to the setting of knob 78, balls will be returned selectively to one or other end of the tennis court. Limbs 62 and 64 are provided with pivotal extensions 80, 82 mounted on suitable ball and socket-type joints, the angular positioning of the respective extensions determining the location on the court to which returned balls are directed. Adjustment screws 84, 86 allow the extensions to be fixed in position.

Paddle device 72 may be operated electrically, for example, from a battery pack indicated at 88, the mechanism for effecting ball-impacting oscillations thereof being known in the art, and not therefore being described herein in detail. Operation of the paddle device may be controlled through a switch 90 under lever 68, so that when a ball comes to rest against stop 70, depressing the left end of lever 68, operation of the paddle device is initiated. Also the device may include an adjustable timer (not shown) so that operation of the paddle device to return a ball may be set to occur at a pedetermined period after the ball actuates switch 90. For example, a player practicing serves may required mis-hit balls to be returned more quickly than players participating in an actual game.

It will be appreciated from the foregoing that the invention provides a ball-returning tennis net assembly which advantageously fulfills the combined functions of saving a player or players from having to retrieve balls hit into the net, and also of preventing such mis-hit balls from rebounding onto the court where they may present a hazard. In a more economical form of the invention, the net structure and tray may be used without the ball-return mechanism, so that balls hit into the net are guided toward the side of the court, for example. The net structure may also be used on its own if the requirement is simply to prevent rebounding of balls.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ball-returning tennis net assembly comprising a net structure capable of being suspended between standard net support posts on a tennis court in lieu of a conventional tennis net, the net structure including means for gathering balls hit into the structure and dropping such balls to the base of the structure in a manner preventing the balls from rebounding onto the court, ball delivery means at the base of the net structure extending along the length of the net structure for receiving balls hit into the net structure at any location along the length of the structure and for directing the balls to one end of the net structure, and a ball-return mechanism for receiving balls from said delivery means at said one end of the net structure and for propelling the balls to a selected location on the court, wherein the ball delivery means comprises an elongate inclined ball-delivery tray, and the net structure comprises an inner ball-impenetrable net extending substantially over the longitudinal center line of the tray, and a pair of outer nets on opposite sides of said inner net respectively, said outer nets having upper ball-penetrable sections and lower sections respectively embracing the tray, said upper sections being constructed in a manner such that balls will pass therethrough and impact said inner net but will prevent balls from rebounding from said inner net through said upper sections and onto the court.

2. The invention of claim 2 wherein the inner net is of conventional tennis net mesh and has an inclined lower edge spaced above and in parallel with the inclined base of the tray.

3. The invention of claim 2 wherein the inner and outer nets are each suspended from a cable, the respective cables being secured at the apexes of respective triangular brackets spaced lengthwise of the net structure.

4. The invention of claim 3 wherein the respective cables are wound together at opposite ends of the net structure to form a single attachment to each of the net posts.

5. The invention of claim 1 wherein the upper section of each outer net comprises a plurality of spaced vertically extending rods suspended from a cable, the spacing between the rods permitting passage of a ball, and the lower section of each outer net comprises a mesh structure joined to the bases of the rods.

6. The invention of claim 5 wherein the rods are of hollow triangular form with their apexes directed outwardly of the net structure.

7. The invention of claim 2 wherein the ball-return mechanism includes means for selectively returning balls toward opposite ends of the court.

8. The invention of claim 7 wherein the ball-return mechanism includes means for adjusting the location to which balls are delivered at opposite ends of the court.

9. A ball-returning tennis net assembly comprising a net structure capable of being suspended between standard net support posts on a tennis court in lieu of a conventional tennis net, the net structure including means for gathering balls hit into the structure and dropping such balls to the base of the structure in a manner preventing the balls from rebounding onto the court, ball delivery means at the base of the net structure extending along the length of the net structure for receiving balls hit into the net structure at any location along the length of the structure and for directing the balls to one end of the net structure, and a ball-return mechanism for receiving balls from said delivery means at said one end of the net structure and for propelling the balls to a selected location on the court, wherein the ball-return mechanism comprises a hollow, substantially T-shaped member having a central limb for receiving balls from the delivery means, opposed limbs for delivering balls selectively to opposite ends of the court, and a box section at the junction of the limbs, the box section including a ball-projecting paddle mechanism for batting balls selectively through one or other of the opposed limbs and the mechanism including manually settable means for controlling operation of the paddle mechanism to bat balls through one or the other of said opposed limbs.

10. The invention of claim 9 including a pivotal ball-arresting lever in said central limb tipped by a first ball entering said limb from the delivery means to locate the ball in position for impact by the paddle mechanism and prevent any further balls entering the limb from proceeding to the paddle mechanism prior to expulsion of the first ball, the arresting lever further being associated with a switch for initiating operation of the paddle mechanism responsive to tipping of the lever.

11. The invention of claim 9 including angularly adjustable extensions on said opposed limbs for altering the locations to which balls are delivered through the respective limbs.

12. A tennis net structure for preventing balls hit into the structure from rebounding onto a tennis court, the structure comprising an inner ball-impenetrable net, and a pair of outer nets having ball-penetrable upper sections located on opposite sides of the inner net respective, and means for suspending the nets in assembled relation between net supporting posts, said upper sections being constructed in a manner such that balls will pass therethrough and impact said inner net but will prevent balls from rebounding from said inner net through said upper sections and onto the court wherein the central net comprises a conventional tennis net mesh structure, the upper sections of the outer nets comprise spaced vertically disposed rods, and the suspending means comprises a suspension cable for each net and frame means supporting said cables with the outer nets spaced from the inner net.

13. The invention of claim 12 wherein the frame means comprises a plurality of triangular brackets spaced along the length of the structure, with the suspension cables attached to the respective apexes of the brackets whereby the top of the central net is above the tops of the outer nets.

14. The invention of claim 12 wherein the outer nets have mesh lower sections extending substantially to ground level.

15. The invention of claim 12 wherein the central net has an inclined bottom edge spaced above ground level for use with an elongate inclined ball-delivery tray positioned under the net.

* * * * *